US008051500B2

(12) United States Patent
Lee

(10) Patent No.: US 8,051,500 B2
(45) Date of Patent: Nov. 8, 2011

(54) SAFETY HELMET VISOR SETTING MECHANISM

(75) Inventor: Te Lung Lee, Yung Kang (TW)

(73) Assignee: Long Huei Helmet Co., Yung Kang (TW)

( * ) Notice: Subject to any disclaimer, the term of this patent is extended or adjusted under 35 U.S.C. 154(b) by 448 days.

(21) Appl. No.: 12/209,245

(22) Filed: Sep. 12, 2008

(65) Prior Publication Data

US 2010/0064406 A1 Mar. 18, 2010

(51) Int. Cl.

| | |
|---|---|
| ***A42B 1/08*** | (2006.01) |
| ***A42B 1/06*** | (2006.01) |
| ***A63B 71/10*** | (2006.01) |
| ***A61F 9/00*** | (2006.01) |

(52) U.S. Cl. ..... 2/424; 2/410; 2/425; 2/10

(58) Field of Classification Search ..... 2/410, 6.1, 2/6.2, 6.3, 6.4, 6.5, 6.6, 6.7, 6.8, 421, 422, 2/423, 424, 425, 10, 9, 171, 209.12, 209.13; D29/102, 103, 104, 105, 106, 107, 108, 109, D29/110

See application file for complete search history.

(56) References Cited

U.S. PATENT DOCUMENTS

| | | | | |
|---|---|---|---|---|
| 3,473,166 | A * | 10/1969 | Lobelle | 2/6.5 |
| 4,292,688 | A * | 10/1981 | Ellis | 2/6.4 |
| 5,185,889 | A * | 2/1993 | Kamata | 2/424 |
| 5,329,642 | A * | 7/1994 | Dampney | 2/424 |
| 6,301,721 | B1 * | 10/2001 | Arai | 2/424 |
| 6,892,400 | B1 * | 5/2005 | Choi et al. | 2/424 |
| 7,210,174 | B2 * | 5/2007 | Yeh | 2/424 |
| 2002/0129440 | A1 * | 9/2002 | Hong et al. | 2/422 |
| 2003/0182717 | A1 * | 10/2003 | Choi et al. | 2/424 |
| 2004/0049830 | A1 * | 3/2004 | Gafforio et al. | 2/171 |
| 2006/0080761 | A1 * | 4/2006 | Huh | 2/424 |
| 2007/0124851 | A1 * | 6/2007 | Pyo | 2/424 |
| 2008/0216215 | A1 * | 9/2008 | Lee | 2/424 |
| 2009/0070908 | A1 * | 3/2009 | Gafforio et al. | 2/15 |

* cited by examiner

*Primary Examiner* — Gary L Welch
*Assistant Examiner* — Jane Yoon
(74) *Attorney, Agent, or Firm* — Alan Kamrath; Kamrath & Associates PA

(57) ABSTRACT

A safety helmet visor setting mechanism includes a shell having a shaft base inside at each side, with one side provided with a shell base provided with an internal lodging space and with an external wall. A control mechanism, located at the right side of the shell, has a knob for turning and driving an actuating element that again links a handle to rotate a displacement. The knob and the actuating element are provided with a fixed dish in between and provided with corresponding oblique chunks and sliders in between. The fixed dish and the handle are provided with corresponding clasp segments and lumps. A joint mechanism, set up on the shaft base of both sides of the shell, includes a first visor joint and a second visor joint each provided with hollows. The first visor joint and the handle of the control mechanism are linked by a rod. A visor has a clasp slice at each of both sides for insertion into the hollow of the visor joint.

8 Claims, 10 Drawing Sheets

(B-B)

(A-A)

(1)

(2)

(3)

SAFETY HELMET VISOR SETTING MECHANISM

BACKGROUND OF THE INVENTION

1. Field of the Invention

The present invention relates to safety helmet visor setting mechanisms and, more particularly, to one that features easy lifting of the visor and handy assembly or disassembly.

2. Description of the Prior Art

The general safety helmet protective lens is categorized as a windshield visor fixed outside the shell, and a sunshade visor fixed inside the shell. The latter is installed inside the shell and located between the shell and the Styrofoam inner helmet. Once the visor is damaged and in need for replacement, the helmet liner fixed in the inner helmet is unloaded, the inner helmet is discharged, and, then, the visor is ready for removal for replacement. The reloading is accomplished by reversing the whole procedure, which is troublesome. Moreover, the installation of the helmet liner involves specialized skills and practice. The appropriateness of the installation affects considerably the fit and comfort of the head of the user, which may substantially distract the user, and it absolutely calls for great improvement.

SUMMARY OF THE INVENTION

The main object of the present invention is to provide a safety helmet visor setting mechanism which allows easy lifting of the visor.

Another object of the present invention is to provide a safety helmet visor setting mechanism which is handy for assembly or disassembly of the visor and which proves to have greatly improved the drawbacks of the prior art.

DETAILED DESCRIPTION OF THE INVENTION

Figure 1:
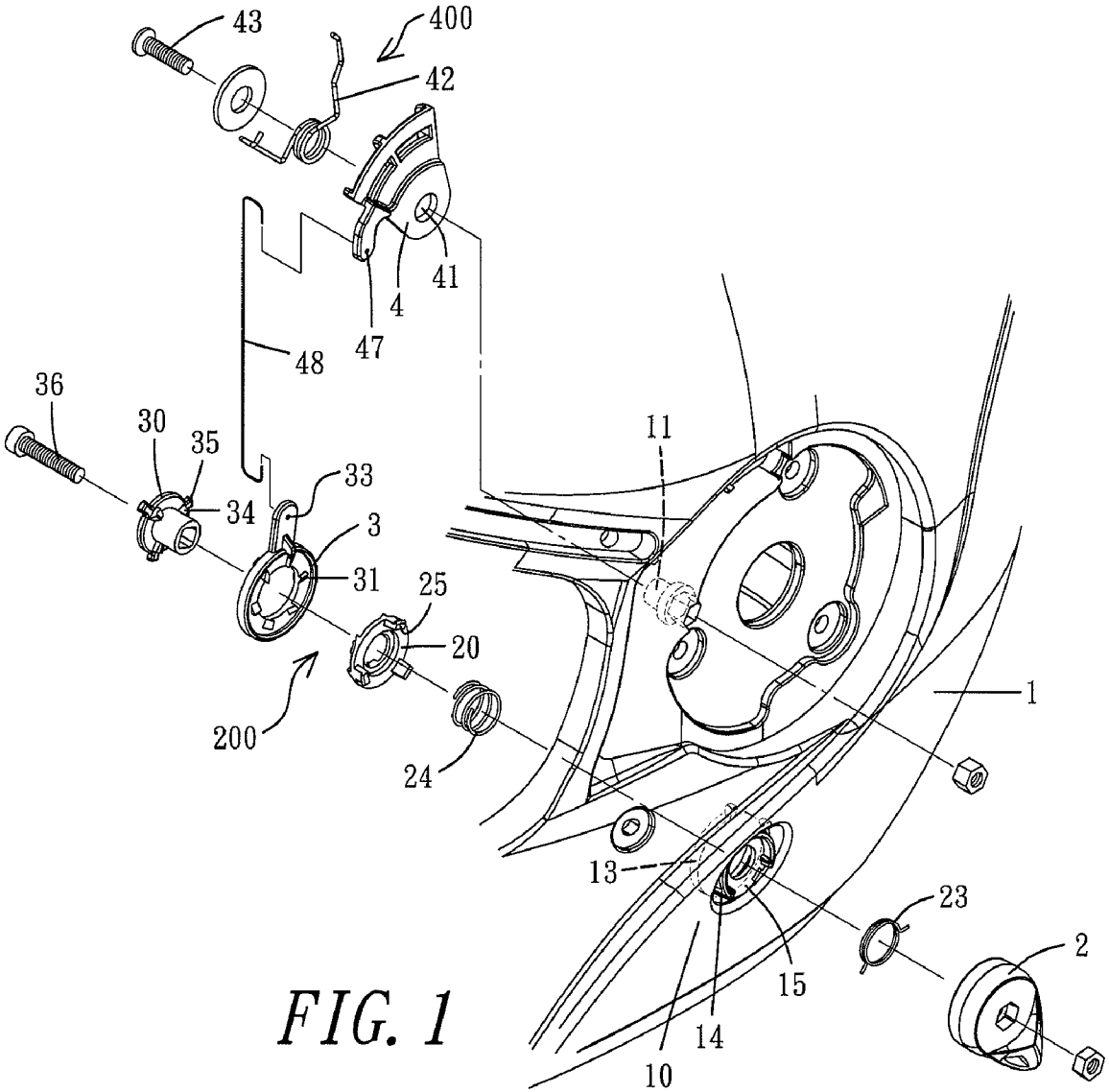
FIG. 1 is a three-dimensional exploded view of the right side portion of the shell of the present invention.
Figure 5:
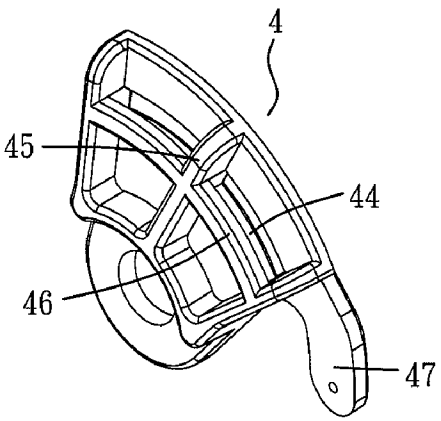
FIG. 5 shows a three-dimensional diagram of the first visor joint of FIG. 1.
Figure 4:
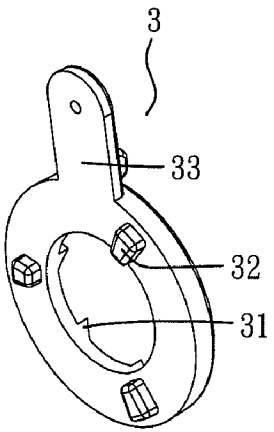
FIG. 4 shows a three-dimensional diagram of the handle of FIG. 1.
Figure 3:
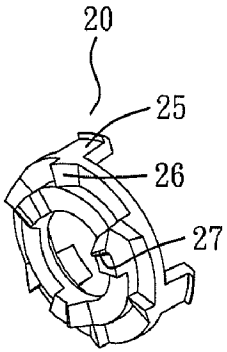
FIG. 3 shows a three-dimensional diagram of the fixed dish of FIG. 1.
Figure 2:
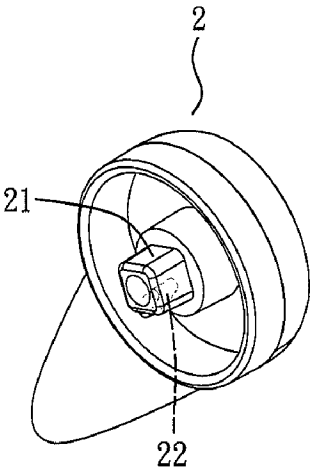
FIG. 2 shows a three-dimensional diagram of the knob of FIG. 1.

To achieve the foregoing objects of the present invention, the techniques adopted and the achievable function are detailed and described with reference to the following preferred exemplified embodiment and the accompanying drawings, which is expected to help comprehending the contents of the present invention thoroughly.

Referring to FIGS. 1-8, the present invention comprises a shell 1 having a shaft base 11, 12 inside at each of both sides. The shaft base 11 at the right side is provided with a shell base 10 at its bottom, and the shell base 10 is provided with a lodging space 13 inside. The lodging space 13 has a plurality of through holes at its bottom, and the shell base 10 is provided with a wall 14 outside and having a gap 15 at one side.

Figure 12:
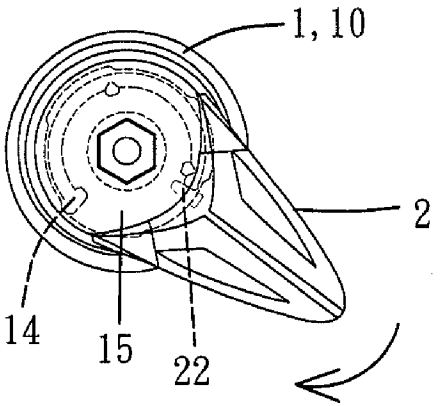
FIG. 12 is a schematic diagram of the knob at position (1) of the present invention.

A control mechanism 200, set up at the right side of the shell 1, includes a knob 2 located at the outer of the wall 14 of the shell base 10. Knob 2 has an external adjusting piece and an internal rectangular shaft 21. Corresponding to the gap 15 of the wall 14, internally, knob 2 has a barrier 22. The fitting between the barrier 22 and the gap 15 of the wall 14 forms the constraints (referring to FIGS. 12-14) of the knob 2 during its turning up and down. A torque spring 23 is placed internally of the wall 14 of the shell base 10 and the knob 2. The two sides of the torque spring 25 jostle with the wall 14 and the knob 2 respectively. A spring 24 is located in the lodging space 13 of the shell base 10. A fixed dish 20 has a plurality of clasp pins 25 at its one end, with the clasp pins 25 used for seizing in the through holes of the lodging space 13 of the shell base 10 and, at the same time, pressing the spring 24. The other end of the fixed disk 20 is provided with equally distanced, uneven, oblique chunks 26 and a clasp segment 27. The clasp segment 27 is a bit taller than the oblique chunks 26. A handle 3, annular in shape, is located on the fixed dish 20. One surface of the handle 3 is provided with a plurality of equally distanced sliders 31 which correspond with the oblique chunks 26 of the fixed dish 20, with both the sliders 31 and oblique chunks 26 each having an oblique surface fitting to each other. The other surface of the handle 3 is provided with a plurality of equally distanced, clasp chunks 32. The handle 3 is provided with a protruded link bar 33 at its one side. An actuating element 30, being T-shaped, has one end formed as circular tube able to penetrate the handle 3 and the fixed dish 20, and the circular tube has a square hole at its inside to join the shaft 21 of the knob 2. The other end of the actuating element 30 is in the shape of a disk protruded out from the handle 3. The actuating element 30 has a plurality of equally distanced lumps 34 at its bottom corresponding to the clasp segments 27 of the fixed dish 20, with both the lumps 34 and the clasp segments 27 each having an oblique surface fitting to each other. The rim of the actuating element 30 has a plurality of equally distanced push pieces 35 that reside within the intervals of the clasp chunks 32. The control mechanism 200, made up of the above knob 2, torque spring 23, spring 24, fixed dish 20, handle 3 and actuating element 30, is formed by fastening the above parts to both sides of the shell 1 with a screw 36. Through the restoring force of the spring 24, the fixed dish 20 always moves leftward (outward), which makes the oblique chunks 26 and the clasp segments 27 of the fixed dish 20 to jostle with the backside of the actuating element 30 and the handle 3, to form a match between the oblique chunk 26 and the slider 31 and between the clasp segment 27 and the lump 34. Both the foregoing mentioned oblique chunks 26 of the fixed dish 20 and the sliders 31 of the handle 3 are six equally distanced pieces. The clasp chunks 32 of the handle 3, the push pieces 35 of the actuating elements 30, the clasp segments 27 of the fixed dish 20 and the lumps 34 of the actuating elements 30 are all three equally distanced pieces.

A joint mechanism 400, situated at each of two sides of the shell 1, is joined to a visor 6 for fixing and includes a first visor joint 4 having a round hole 41 at its bottom portion to put on the shaft base 11 inside the right side of the shell 1. The shaft base 11 is also encircled by a torque spring 42 having its two ends joined at one side of the first visor joint 4 and the top portion of the shell 1. A screw 43 fastens the torque spring 42 and the first visor joint 4 to the shell 1. The first visor joint 4 is provided with a hollow 44 at its top portion. The hollow 44 is provided with a vertical divider 45 at its middle and with a horizontal post 46 at its top outside, to form the entrance of the hollow 44. The first visor joint 4 is provided with a link slice 47 at one side of the top portion, which connects to the link bar 33 of the handle 3 through a rod 48.

Figure 9:
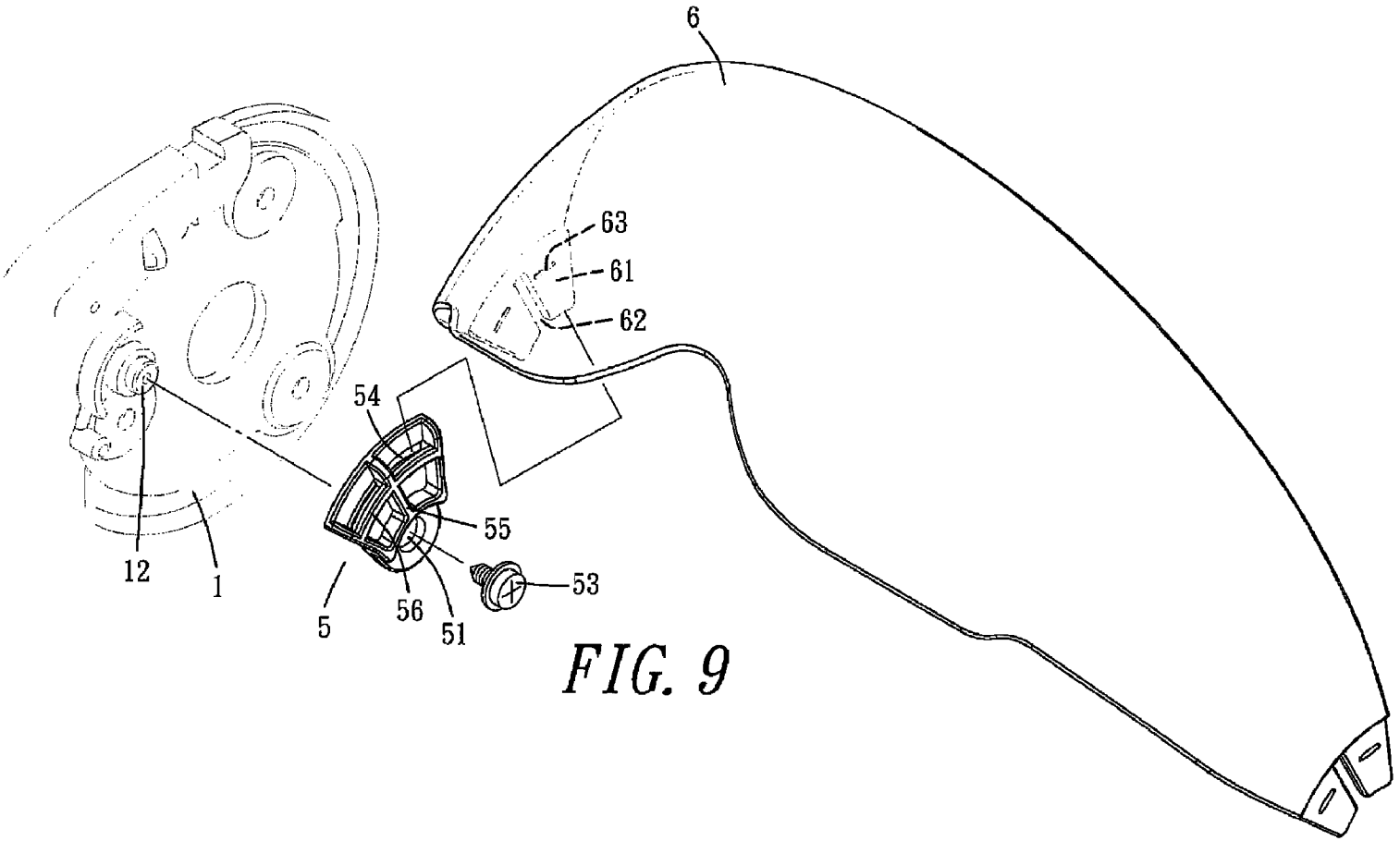
FIG. 9 is a three-dimensional exploded view of the left side portion of the shell of the present invention.
Figure 10:
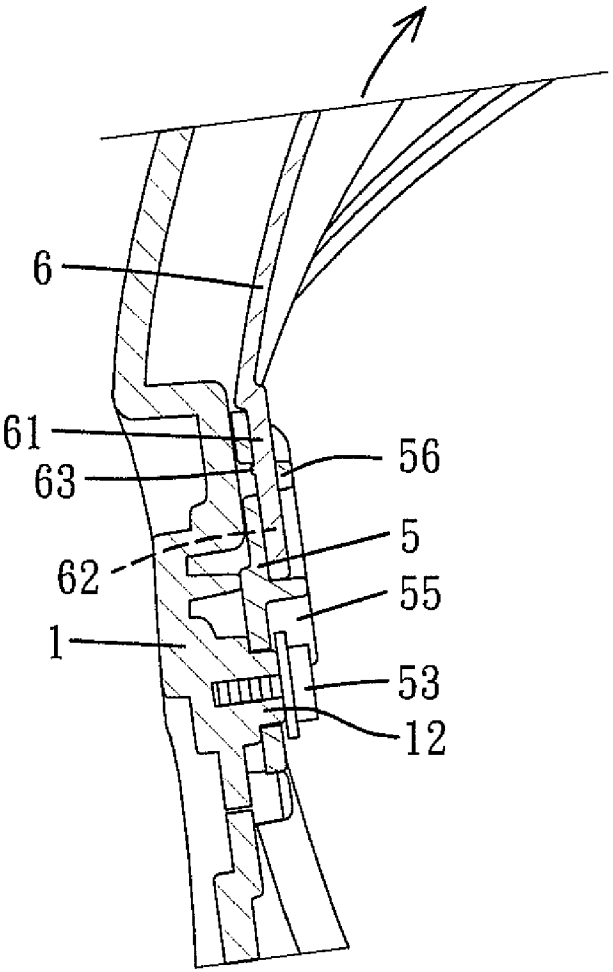
FIG. 10 is an assembled sectional view of the left side portion of the shell of the present invention.

A second visor joint 5, referring to FIGS. 9 & 10, is put on the shaft base 12 inside at the left side of the shell 1 and is fastened by a screw 53. The second visor joint 5 has a structure similar to the first visor joint 4 [H] and has the same round hole 51, hollow 54, divider 55 and horizontal post 56, but excluding a torque spring and a link slice.

The visor 6, referring to FIGS. 5, 6, 8, 9 & 10, is shaped as an indented arc and has a clasp slice 61 at each of two sides for inserting into the hollows 44 & 54 of the first and the second visor joints 4 & 5. The clasp slice 61 is provided with a dent 62 at its middle, for the insertion of the dividers 45 & 55 and is provided with protruded bars 63 at its outside, which joins the inner sides of the horizontal post 46 (right end) and the hollow 54 (left end).

Figure 6:
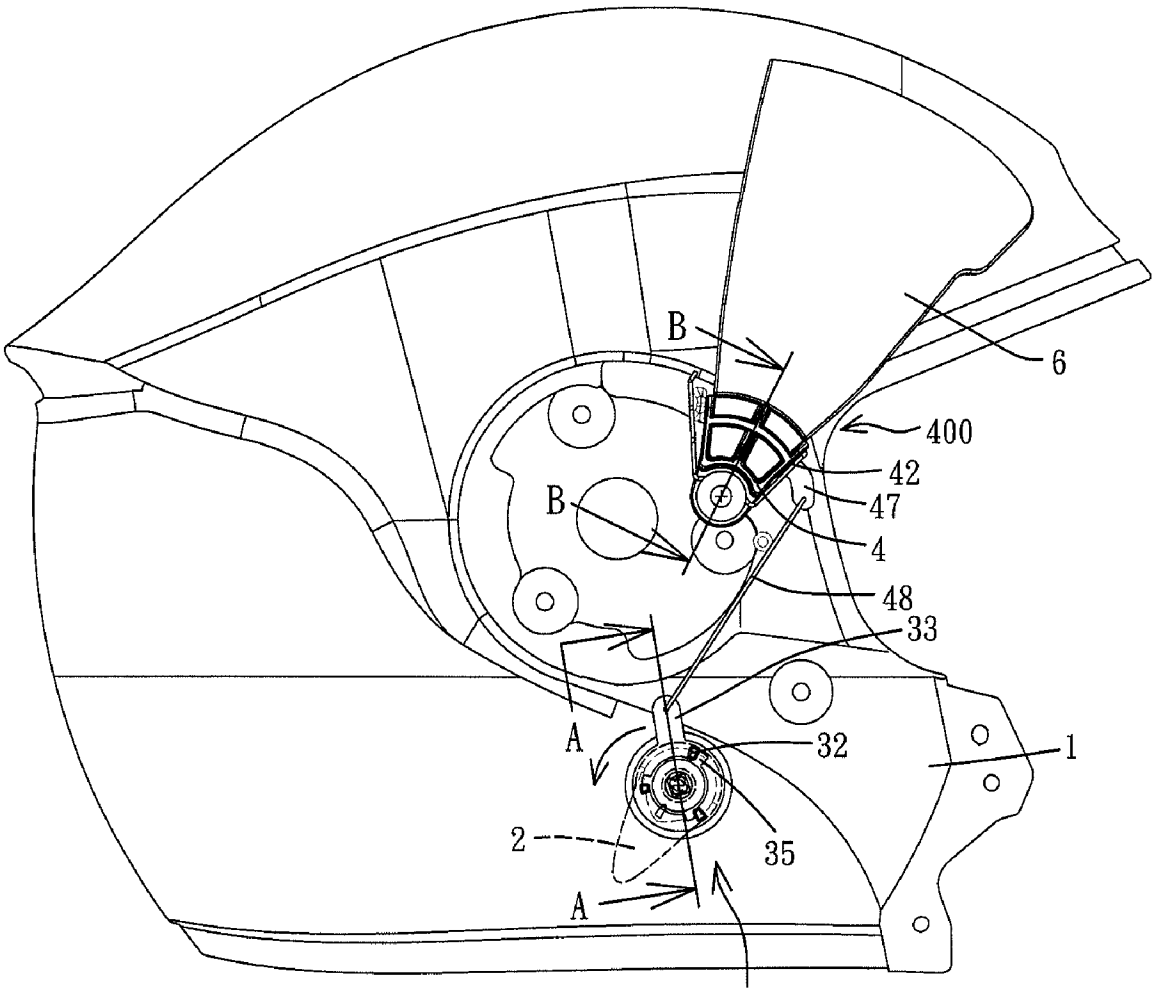
FIG. 6 is a schematic side view of the lifting of the visor of the present invention.
Figure 8:
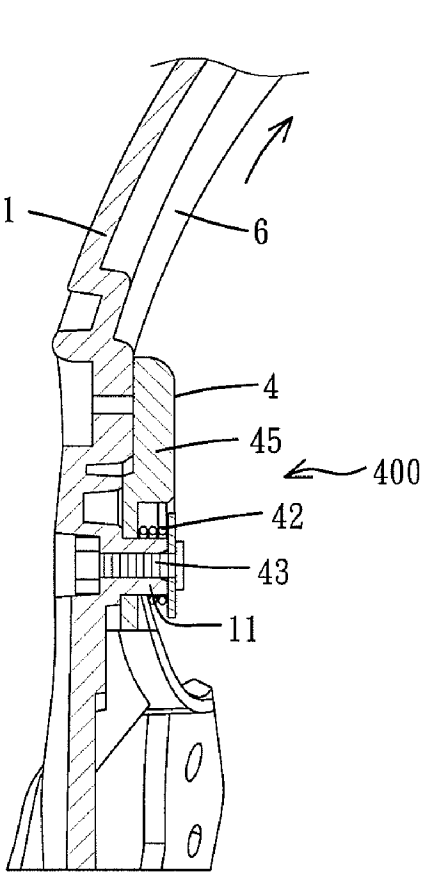
FIG. 8 shows a sectional diagram viewing from B-B in FIG. 6.
Figure 7:
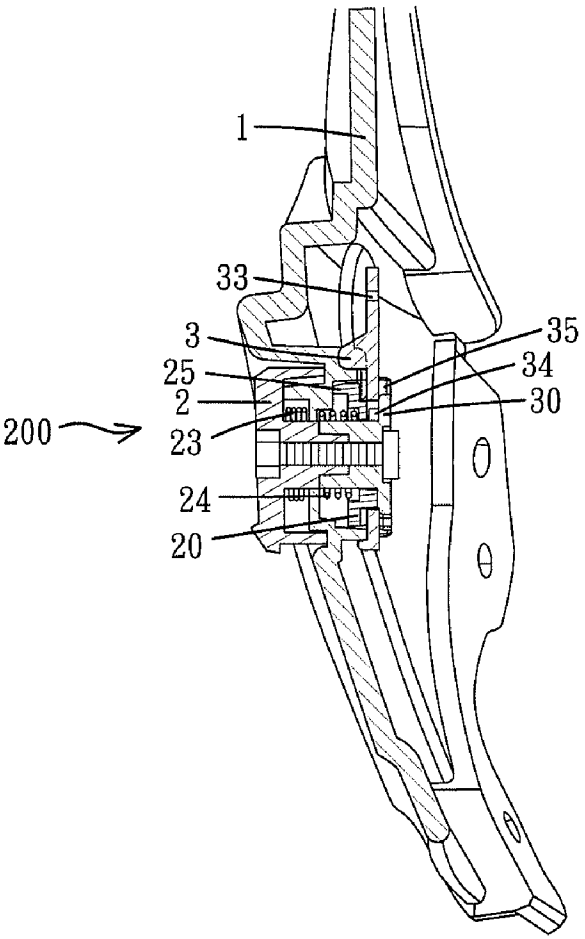
FIG. 7 shows a sectional diagram viewing from A-A in FIG. 6.
Figure 16:
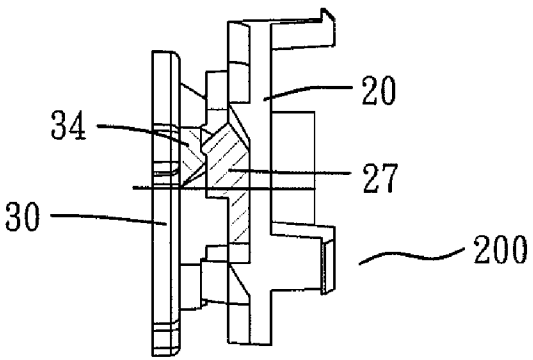
FIG. 16 is a schematic diagram of the relative positions of the fixed dish and the actuating element at position (1) of the present invention.
Figure 15:
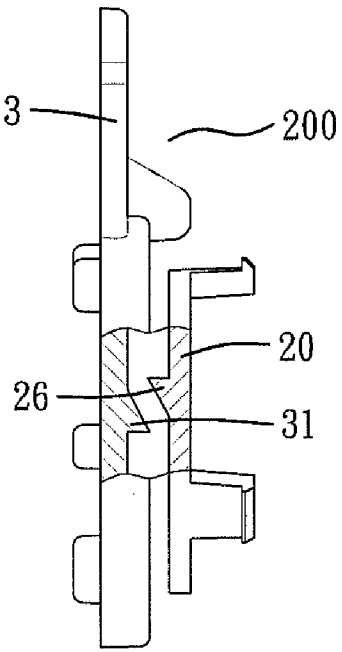
FIG. 15 is a schematic diagram of the relative positions of the fixed dish and the handle at position (1) of the present invention.

According to the foregoing structural combination, both ends of the visor 6 join the first and the second visor joints 4 & 5 respectively, and a rod 48 links the control mechanism 200 to the joint mechanism 400, shown in FIGS. 6, 8, & 10. When not in use, the visor 6 is hidden internally of the shell 1 and is facing upward as the first and the second visor joints 4 & 5 do, and the link bar 33 of the handle 3 appears on the top position, shown in FIG. 6. Meanwhile, the knob 2 is at position (1), and the clasp segment 27 of the fixed dish 20 and the lump 34 of the actuating element 30 appear to jostle against each other, shown in FIG. 16. While the oblique chunk 26 of the fixed dish 20 and the slider 31 of the handle 3 appear separated (untouched), shown in FIG. 15, the fixed dish 20 is connected by the spring 24. Once the clasp segment 27 of the fixed dish 20 and the lump 34 of the actuating element 30 jostle against each other, the fixed dish 20 is forced to move inward (right), makes the spring 24 pressed, and, at the same time, pushes the oblique chunk 26 of the fixed dish 20 and the slider 31 of the handle 3 to separate from each other.

Figure 18:
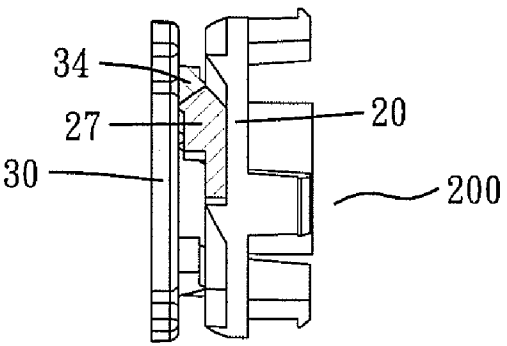
FIG. 18 is a schematic diagram of the relative positions of the fixed dish and the actuating element at position (2) of the present invention.
Figure 17:
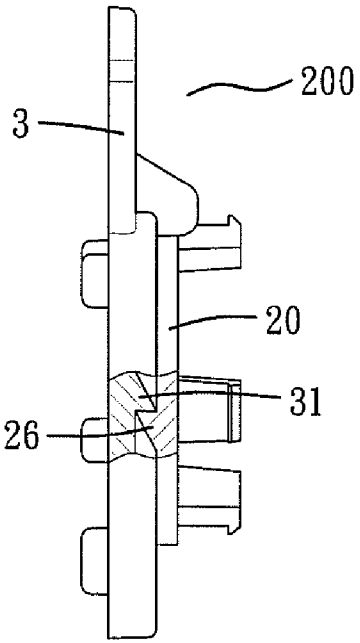
FIG. 17 is a schematic diagram of the relative positions of the fixed dish and the handle at position (2) of the present invention.
Figure 20:
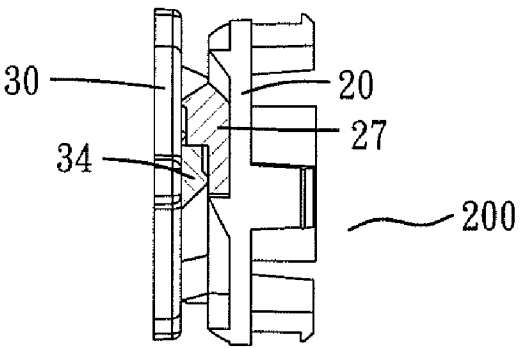
FIG. 20 is a schematic diagram of the relative positions of the fixed dish and the actuating element at position (3) of the present invention.
Figure 19:
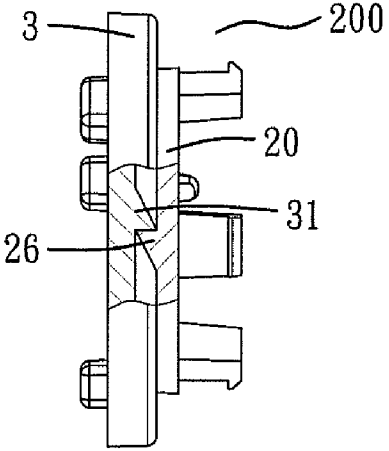
FIG. 19 is a schematic diagram of the relative positions of the fixed dish and the handle at position (3) of the present invention.

When the visor 6 is in use, the knob 2 is turned downward (inward) (shown by the arrow in FIG. 12), up to the position (3) (shown in FIG. 14), to drive the actuating element 30 simultaneously to rotate a certain angle. Through the push piece 35 of the actuating element 30 pushing the clasp chunk 32 of the handle 3 (shown in FIG. 6), the handle 3 is forced to rotate inward the certain angle. Again, through the linkage of the link bar 33, the rod 48 and the link slice 47, the first visor joint 4 is thus driven to rotate downward for an angle with the shaft base 11 as the axis, which will drive the visor 6 to descend to be in place, that is, right at the window in the front of the shell 1, for sunshade purposes, shown in FIG. 11. Once the knob 2 is at position (3), the oblique chunk 26 of the fixed dish 20 joins closely the backside of the slider 31 of the handle 3, while the clasp segment 27 of the fixed dish 20 joins the front side of the lump 34 of the actuating element 30, shown in FIGS. 19 & 20. The knob 2 accommodates a torque spring 23 internally. Through the restoring force of the torque spring 23, the knob 2 is forced to immediately return to position (2), shown in FIG. 13, and to simultaneously drive the actuating element 30 to turn back an angle. At the moment, the oblique chunk 26 of the fixed dish 20 harmonizes with the slider 31 of the handle 3, and the clasp segment 27 of the fixed dish 20 harmonizes with the lump 34 of the actuating element 30, shown in FIGS. 17 & 18. The push piece 35 of the actuating element 30 is located in between the clasp chunks 32 of the handle 3 (shown in FIG. 11), which targets for easy operation of the next step.

Figure 13:
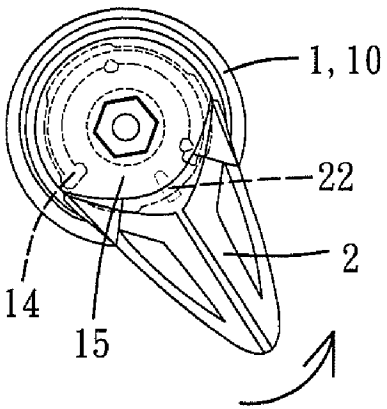
FIG. 13 is a schematic diagram of the knob at position (2) of the present invention.
Figure 14:
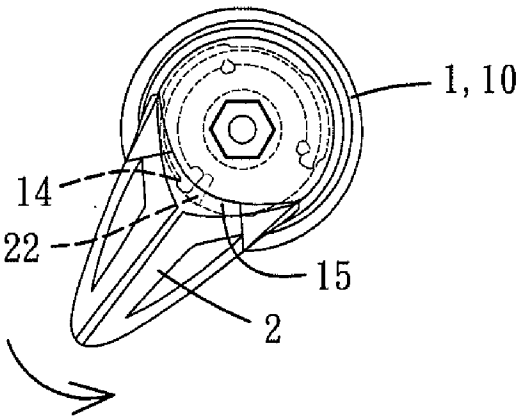
FIG. 14 is a schematic diagram of the knob at position (3) of the present invention.

When the sunshade isn't demanded, the procedure is to turn the knob 2 upward according to the arrow shown in FIG. 13 to position (1), which simultaneously drives the actuating element 30 to turn an angle. Thus, the oblique chunk 26 of the fixed dish 20 and the slider 31 of the handle 3 separate from each other (shown in FIG. 15), while the clasp segment 27 of the fixed dish 20 and the lump 34 of the actuating element 30 appear to jostle against each other (shown in FIG. 16). The first visor joint 4 is then lifted promptly subject to the restoring force of the torque spring 42 and simultaneously drives the visor 6 to hide inside in the top of the shell 1, shown in FIG. 6.

As regards the up-down operation with the visor 6, the first visor joint 4 rotates with respect to the shaft base 11 of the shell 1 as the rotational axis, and the second visor joint 5, in the same way, takes the shaft base 12 of the other end of the shell 1 as its rotational axis. Therefore, the second visor joint 5 can be driven to rotate simultaneously by the first visor joint 4 and the visor 6.

Figure 11:
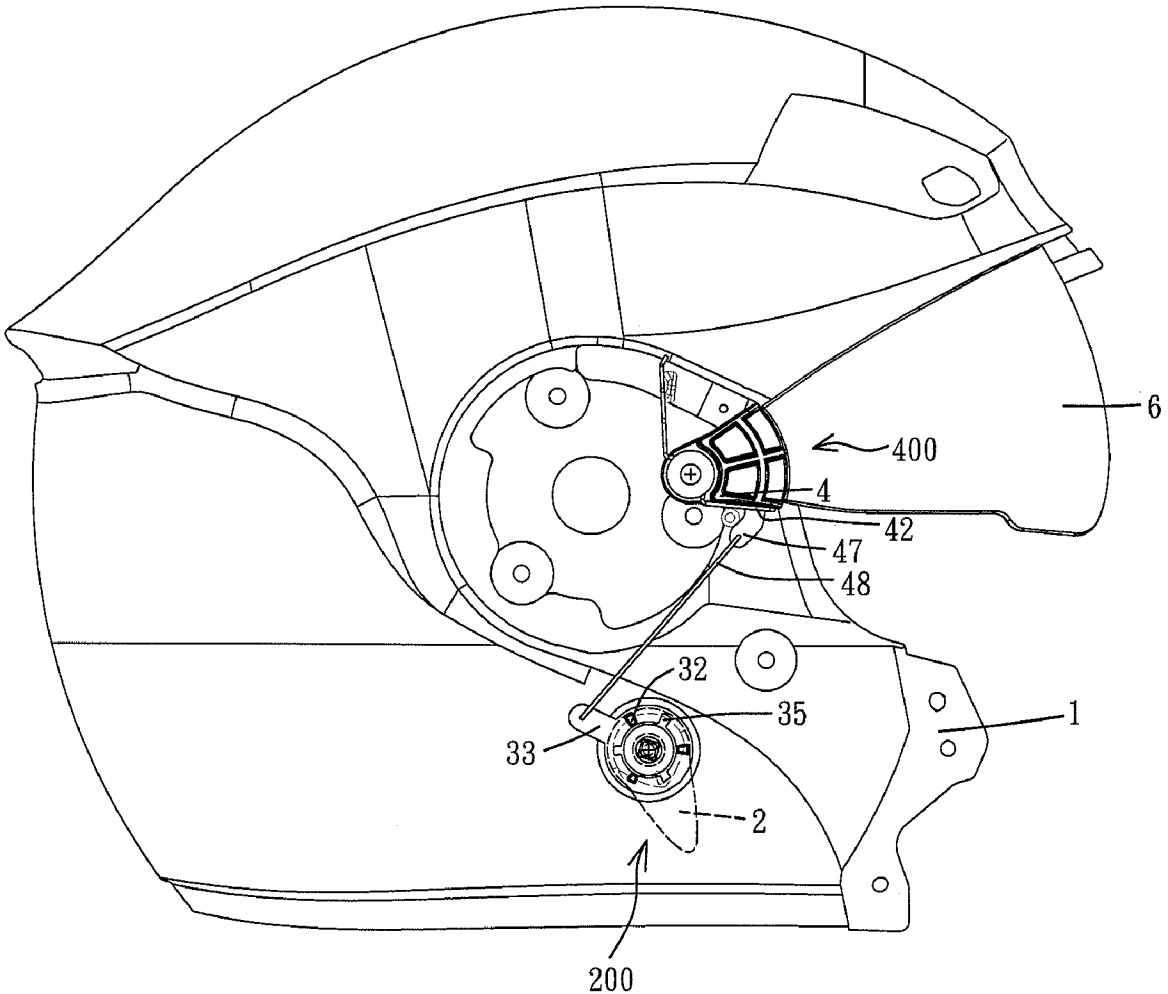
FIG. 11 is a schematic side view of the lowering of the visor of the present invention.

When the visor 6 is to be unloaded, the visor 6 is pressed down first, shown in FIG. 11, the middle portion of the visor 6 is held by hand, with a slight outward pull, according to the arrow shown in FIGS. 8 & 10, and the clasp slices 61 at both sides of the visor 6 are easy to be unloaded from the hollows 44 & 54 of the first and the second visor joint 4 & 5. Reversely, loading is accomplished by first inserting the clasp slice 61 at the left side of the visor 6 into the hollow 54 of the second visor joint 5, shown in FIG. 10, followed by inserting the clasp slice 61 at the right side of the visor 6 into the hollow 44 of the first visor joint 4, shown in FIG. 8. Meanwhile, the dividers 45 & 55 are inserted into the dents 62 of the visor 6, and the protruded bars 63 are seized in the horizontal post 46 and the inner side of the hollow 54, which then puts the visor 6 in place, and ready for lifting or lowering, shown in FIGS. 6 & 11.

Moreover, the separation and combination of the control mechanism 200 of the present invention is accomplished by the up or down displacement of the knob 2 and, again, through the rod 48 pulling the first visor joint 4 of the joint mechanism 400 for a lifting or a lowering, to further drive the visor 6 to lift or lower, which is pretty easy, handy and prompt.

From the description in the above, the present invention features at least the following advantages and functions, which is more creative than the prior art.

1. The assembly or disassembly of the visor 6 is not only easy and prompt but free of stripping or installing the helmet liner and without need of any tools.

2. The lifting or lowering of the visor 6 is not only easy and prompt but economical of effort.

It's worth to lay particular stress that the traits and spirit of the design of the helmet visor setting mechanism of the present invention contain not only the control mechanism 200 and the joint mechanism 400, but the integrated structure made up of the clasp slices 61 at both sides of the visor 6 and the first visor joint 4 and the second visor joint 5. Therefore, any variations of equivalent structure that make use of the techniques and design spirit of the present invention come within the range of the claims of the present invention.

To sum up, the disclosed concrete structure of the exemplified embodiment of the present invention is not only unknown to the prior art, but surely can accomplish the expected objective and function, which is construed as absolutely novel and having creativeness.

What is claimed is:

1. A safety helmet visor setting mechanism, comprising:

a.) a shell having a shaft base inside at each of two sides, with one side being provided with a shell base, where the shell base is provided with an internal lodging space and with an external wall;

b.) a control mechanism located at the one side of said shell and having a knob for turning and driving an actuating element linking a handle to rotate a displacement, wherein the knob and the actuating element are provided with a fixed dish in between, with the fixed dish and the actuating element provided with corresponding oblique chunks and sliders in between, with the fixed dish and the handle provided with corresponding clasp segments and lumps;

c.) a joint mechanism set up on the shaft base of each side of said shell and comprising a first visor joint and a second visor joint, with the first and second visor joints being provided with hollows, wherein the first visor joint and the handle of said control mechanism are linked by a rod; and d.) a visor having a clasp slice at each of both sides for insertion into the hollow of the corresponding visor joint;

wherein through adjustment of the knob of said control mechanism, the actuating element and the handle are driven for carrying out a rotational displacement and, through the handle, simultaneously driving the first visor joint of said joint mechanism for the rotational displacement, to control lifting and lowering of said visor.

2. A safety helmet visor setting mechanism as in claim 1 wherein a wall of the shell base of said shell is provided with a gap, with the knob being provided with a corresponding barrier.

3. A safety helmet visor setting mechanism as in claim 1 wherein said control mechanism comprises:

a.) the knob located outside of the external wall of the shell base of said shell and having an external adjusting piece and an internal shaft;

b.) a torque spring placed between the external wall of the shell base and the knob, wherein two sides of the torque spring jostle with the external wall and the knob respectively;

c.) a spring located in the lodging space of the shell base;

d.) the fixed dish located in the lodging space of the shell base and pressing the spring and having a plurality of uneven distanced oblique chunks and clasp segments;

e.) the handle located on the fixed dish, wherein one end of the handle is provided with a plurality of distanced sliders which correspond to the oblique chunks of the fixed dish, another end of the handle is provided with a plurality of distanced clasp chunks, and one side of the handle being provided with a link bar;

f.) the actuating element having one end to penetrate the handle and the fixed dish and joining the internal shaft of the knob and having another end protruding out from the handle, with the actuating element having a plurality of distanced lumps at a bottom which correspond to the clasp segments of the fixed dish and having a plurality of distanced push pieces at a rim for pushing the clasp chunks of the handle; and g.) a screw.

4. A safety helmet visor setting mechanism as in claim 3 wherein the oblique chunks of the fixed dish and the sliders of the handle each has a corresponding oblique surface and are six equally distanced pieces.

5. A safety helmet visor setting mechanism as in claim 3 wherein the clasp segments of the fixed dish and the sliders of the actuating element each has a corresponding oblique surface and are three equally distanced pieces.

6. A safety helmet visor setting mechanism as in claim 3 wherein the clasp chunks of the handle and the push pieces of the actuating element are both three equally distanced pieces.

7. A safety helmet visor setting mechanism as in claim 1 wherein said joint mechanism comprises:

a.) the first visor joint pivoted on the shaft base at the one side of said shell and having a torque spring, with the first visor joint provided with the hollow on top and with a link slice at one side; and b.) the second visor joint pivoted on the shaft base at the other side of said shell and provided with the hollow on top.

8. A safety helmet visor setting mechanism as in claim 7 wherein said first and second visor joints each is provided with a divider in a middle portion and with an outside horizontal post at the top, wherein each clasp slice of said visor is provided with a dent at a middle portion and with outside protruded bars.

* * * * *